United States Patent [19]

Florence

[11] Patent Number: 4,983,069

[45] Date of Patent: Jan. 8, 1991

[54] DRYWELL, DRYWELL SYSTEM AND METHOD FOR CONTROLLING THE FLOW AND DIRECTION OF SURFACE WATER

[76] Inventor: Thomas Florence, 817 Shoot Flying Hill Rd., Centerville, Mass. 02632

[21] Appl. No.: 394,635

[22] Filed: Aug. 16, 1989

[51] Int. Cl.[5] ..... B01D 21/10

[52] U.S. Cl. ..... 405/43; 405/36; 52/169.5

[58] Field of Search ..... 52/169.5, 20; 405/36, 405/43, 45, 50; 210/164; 137/363

[56] References Cited

U.S. PATENT DOCUMENTS

| | | | |
|---|---|---|---|
| 3,221,881 | 12/1965 | Weiler et al. | 52/169.5 X |
| 3,428,077 | 2/1969 | Scarfe | 52/169.5 X |
| 4,031,009 | 6/1977 | Hicks | 405/36 X |
| 4,298,294 | 11/1981 | Zimmerman | 52/169.5 X |
| 4,789,487 | 12/1988 | Wallace . | |
| 4,805,920 | 2/1989 | Gavin . | |

*Primary Examiner*—David A. Scherbel
*Assistant Examiner*—Jerrold D. Johnson
*Attorney, Agent, or Firm*—Richard P. Crowley

[57] ABSTRACT

An improved drywell, drywell system and method of controlling the flow and distribution of surface water employing a drywell, the drywell comprising a plastic, cylindrical drywell adapted to be positioned beneath the ground, which drywell has at least one large diameter port in the cylindrical wall of the drywell to receive or discharge surface water and a plurality of smaller diameter drain ports, generally uniformly distributed about the cylindrical wall surface of the drywell and a removable bottom cover and a removable top cover, the large and the small diameter ports having a mechanically weakened inner peripheral section, the inner section adapted to be easily removed (knocked out) prior to use. By selection of the ports to be removed the direction and distribution of the flow of surface water beneath the surface may be controlled.

24 Claims, 1 Drawing Sheet

DRYWELL, DRYWELL SYSTEM AND METHOD FOR CONTROLLING THE FLOW AND DIRECTION OF SURFACE WATER

BACKGROUND OF THE INVENTION

The control and flow of surface water, such as rain water, is important in preventing the accumulation of excess surface water near foundations or other structures. Generally drywells are employed to receive therein surface water and to permit the discharge of the surface water beneath the ground and away from the foundation, wall or structure and over a defined area. Typically a drywell would comprise an open pit or a container optionally filled with loose aggregate material, such as gravel or loose stones, into which the surface water is directed either by a grate on the top surface wherein the top surface of the drywell is generally flush or slightly below the ground level or from a pipe which may be connected to the source of surface water, such as rain water from a downspout, and which permits the discharge of the water into the drywell.

Often a simple and effective drywell constitutes a metal drum, such as a 55 gallon drum, with holes perforated in the metal sides thereof and with the drum filled with loose stones and rocks and with a grate placed on the top thereof or a drain pipe directing water into the side of the drywell. Other drywells may comprise precast-type drywells or precast concrete with a hole for an inlet pipe and plurality of holes already precast in the cylindrical walls of the concrete septic tank or drywell to permit the drainage of water therefrom.

It is desirable however to provide for an improved, simple, yet effective drywell to provide for the improved control and flow or direction of the surface water and to a drywell system which uses the improved drywell and to a method of controlling the flow and direction of surface water.

SUMMARY OF THE INVENTION

The present invention is directed to an improved drywell having a plastic polymer or concrete composition and to a drywell system employing the improved drywell and to a method of controlling the flow and distribution of surface water employing the improved drywell of the invention.

The present invention comprises an improved drywell which includes preferably a molded plastic, cylindrical drywell adapted to be positioned beneath the ground and to receive surface water or liquid therein for discharge over a different area in the ground, and the plastic drywell having at least one large diameter port in the cylindrical wall of the drywell to receive or discharge, optionally both, the surface water and a plurality of smaller diameter drain-type ports generally uniformly distributed about the cylindrical wall surface of the drywell and a removable bottom cover and a removable top cover.

The drywell comprises a plastic, typically a molded plastic, wherein the ports formed with a mechanically weakened peripheral inner section so that the said sections are adapted to be easily removed, such as knocked out with a hammer, prior to use. The mechanically weakened inner sections are typically formed during the molding or manufacturing process of preparing the plastic drywell and generally would comprise a series of small, mechanically weakened sections of the plastic material, such as tabs, securing the inner section of the ports to the outer peripheral, slightly spaced apart, surrounding the cylindrical wall of the drywell. The user of the drywell may then knock out or remove those inner weakened sections as desired on the cylindrical wall so as to control the flow and direction of the surface water or discharge from the drywell so as to control the flow between say 60° and 120° in one direction or to select drain ports at one or multiple levels or to randomly knock-out drain ports if so desired to permit the surface water to emanate generally peripherally about the drywell. In any event, the employment of a plastic drywell permits the user to have flexibility in deciding what drain ports to be removed and to control the direction and flow of the water beneath the ground.

The drywell also includes a removable top cover in one embodiment as grate opening and a grate therein in the grate opening so that the top surface of the drywell may be placed generally flush or slightly below the ground level so that the surface water may be received through the grate. Optionally, and additionally if desired, the plastic drywell would include a larger diameter port with a knock-out inner section so that pipe may be inserted in the cylindrical drywell so that the drywell may receive water directly from a pipe.

In addition, of course, the plastic drywell may include an additional large diameter port, generally on the opposite side from the first large diameter port, also with a weakened section so that if desired the drywell may be connected to a second drywell in series, the pipe extending between the first and second drywell. As also contemplated by the invention, the improved drywell may be employed generally vertically beneath the ground with the top or bottom section as desired removed between the intervening, vertically stacked drywells so as to permit the vertically stacked drywells to act as an integral drywell unit.

The plastic drywell of the invention may be employed in a drywell system whereby surface water is directed into the large diameter port or into the top surface of one or both of the drywells. Typically the plastic drywell would include one, or preferably two or three, large diameter ports, approximately four to eight inches in diameter, with mechanically weakened inner sections for knock-out purposes as well as a plurality of smaller diameter drain-type ports generally uniformly distributed throughout the body of the plastic drywell and typically ranging in size from one to three inches in diameter and positioned from four to six inches from each other, substantially all having inner knock-out sections. The drywell may be employed with or without the employment of loose fill aggregate material therein and generally includes a solid bottom cover which may be removed, if desired, in vertical stacking to increase the drainage of surface water, and a removable plastic top cover may contain a grate opening therein or be solid.

The improved drywell is adapted to be employed in a variety of systems wherein water, but more particularly surface water, is to be received and distributed, such as water from the gutter system of a house or from a driveway. However, it is recognized the improved drywell may be employed in any situation where it is desirable to receive a liquid and to distribute a liquid over a defined area with control of the direction or flow of the liquid permitted by the preformed, integrally molded knock-out inner sections of the large and small diameter ports in the cylindrical wall of the drywell.

The plastic drywell can be composed of a wide variety of plastic materials, but typically is formed of a hard and molded plastic which permits the integral molding of the weakened inner sections to provide for a simple, inexpensive drywell. Typical materials which may be employed would include polyethylene, polypropylene, ABS resin, polycarbonates or other polymeric materials. They may be solid or foam, such as polystyrene, so that the foam walls of the polystyrene may include weakened foam inner sections to be easily removed. The inner sections are slightly spaced apart from the body of the cylindrical wall of the plastic drywell a slight distance and secured by tape or tabs of increasingly smaller dimensions or generally uniform tabs of less thickness than the surrounding walls so as to permit the inner section to be removed, such as by striking with a hammer, prior to installation.

The plastic drywell drainage system for the subterranean distribution of surface water would comprise a water source of surface water to be subterraneally flow-distributed away from the water source, such as from the foundation of a house, the water source being the rain water distributed from a gutter system from the roof of a structure, the plastic cylindrical drywell positioned beneath the ground; underground pipe means to direct the flow of surface water from the water source into the drywell or a grate in the top surface of the drywell and the surface water directed into the improved drywell through the grate which is placed generally flush or slightly below the surface of the ground or the low section to receive the water.

The invention also includes a method for the controlled flow of water or other liquid, particularly surface water, from a water or a liquid source which method would comprise providing the improved plastic cylindrical drywell and removing a plurality of the inner sections of the drain ports and optionally the larger diameter ports as required to provide for the desired direction and flow of the water from the interior of the plastic drywell and then installing the drywell so that the top cover is flush or below the ground surface, depending upon whether the water is to be received through a grate or from a pipe and then directing the water, typically surface water, into the interior of the drywell and from the drywell out the drainage ports in the desired direction, as selected by the removal of the ports, and at the desired level, as also determined by the selection of drain ports, at the various levels in the plastic drywell.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DESCRIPTION OF THE EMBODIMENTS

Figure 1:
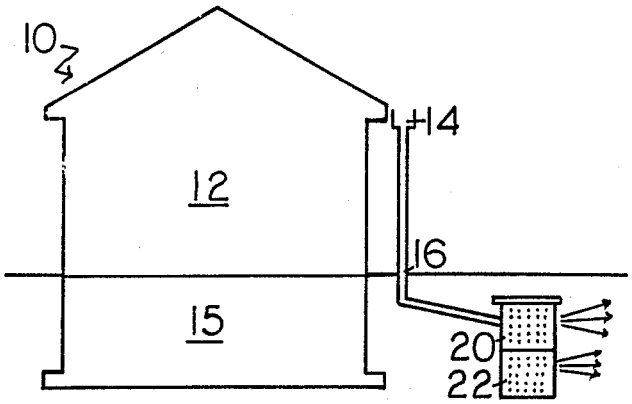
FIG. 1 is a schematic, illustrated, sectional view of the drainage system of the invention showing the employment of the improved drywell.

With reference to the drawing, FIG. 1 shows a drainage system 10 including a structure 12, a gutter 14 and a drain pipe 16 which extends from the gutter downwardly into the ground away from a foundation 15 and into a plastic drywell of the invention 20 which has been placed above another plastic drywell of the invention 22 in a generally vertical alignment with the top cover of 22 removed and with the top cover of 20 in place and the bottom cover of 22 in place. As illustrated in FIG. 1, on the left hand side of the structure 12 water flowing from the roof drops to the ground and may be directed toward the lower section of the foundation 15 if a drywell system is not employed. On the right hand side of FIG. 1 is a typical structure gutter 14 and drain pipe 16, the drain pipe 16 extending beneath the ground and going into an inlet port 30 of the top plastic drywell 20. The arrows indicate the direction of flow as emanating from the two drywells 20 and 22 and showing the flow from a plurality of knock-out holes 23 directed away from the structure 12 by the selection of the knock-out ports on that side of the drywells 20 and 22 thereby directing and controlling the surface water from the roof away from the structure into desired permeation areas.

Figure 2:
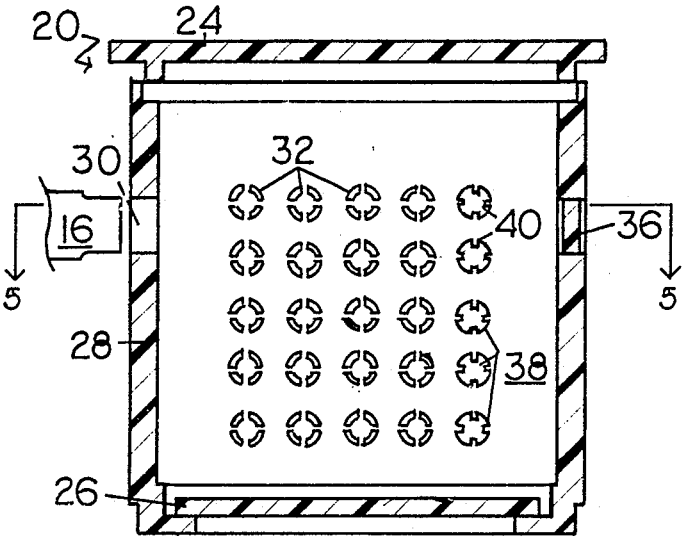
FIG. 2 is an enlarged sectional, partially exploded view of the improved drywell of the invention as employed in FIG. 1.
Figure 4:
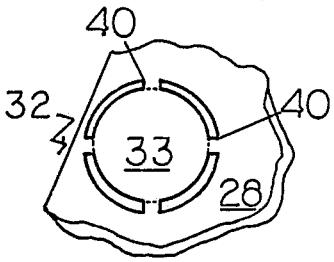
FIG. 4 is an enlarged, fragmentary plan view showing a knock-out drainage port of the improved plastic drywell of the invention as shown in FIG. 2.

FIGS. 2 and 4 illustrate the plastic drywell 20 having a removable top cover 24 and a removable bottom cover 26, the top cover 24 having outwardly extending flanges which fit into a female flange about the top cylinder wall surface 28 of the drywell 20 while the removable bottom cover 26 is designed to fit into a male flange on the lower surface of the drywell 20. The plastic drywell 20 includes the large diameter port 30 shown without a knock-out inner section and with the drain pipe 16 adapted to be placed therein. The plastic drywell 20 also includes a plurality of small diameter ports 32 each with a knock-out section 33, the drywell integrally molded of a plastic-type material and having weakened tabs 40 (see FIG. 4) to connect the inner knock-out sections 33 to the surrounding wall 28 of the drywell 20. As illustrated in FIG. 2, the series of the knock-out section 33 have been removed to provide open drain ports 37 in the cylindrical wall 28 of the drywell 20 all in the right hand side of the drywell 20. In one embodiment, the drywell 20 would have a height of approximately twenty-four inches and a diameter of thirty to thirty-six inches and with the large diameter ports 30, shown as a knock-out, as knocked out four to eight inches, typically four to six inches, and with large diameter port 36, shown as not a knock out, as in place for a possible discharge port of similar size, though the sizes of the ports may vary as well as their position. The smaller diameter ports 32 and a plurality of small diameter ports 38 shown as a knock-out, generally range from two to four inches in diameter are placed from four to six inches apart and are generally illustrated as uniformly distributed throughout the cylindrical wall 28 of the drywell 20.

Figure 3:
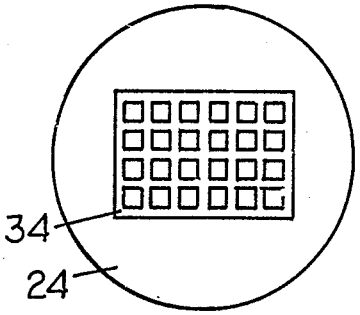
FIG. 3 is a top plan view of the improved drywell of the invention with a grate on the top cover.

As illustrated more particularly in FIG. 3, the top cover 24 may contain a grate opening therein and a grate 34 positioned therein which permits the plastic drywell 20 to stand alone as a single piece drywell installation to receive surface water in low locations, such as driveway valleys, the surface water entering into the grate then into the interior cavity of the drywell.

Figure 5:
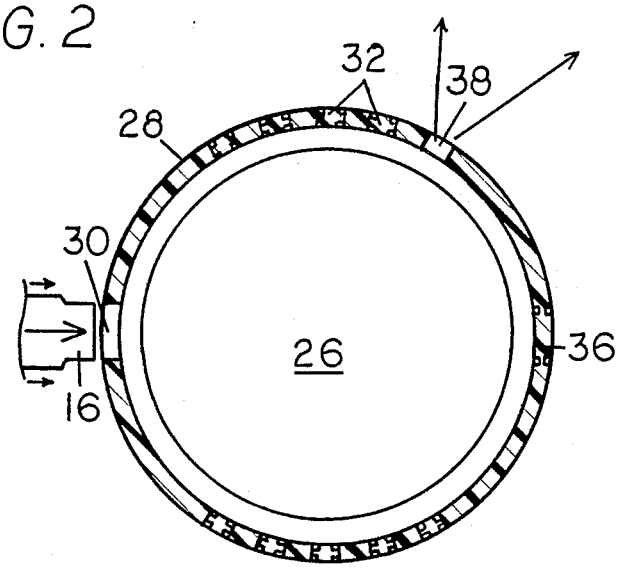
FIG. 5 is a top plan view of the improved plastic drywell of the invention in the drainage system.

FIG. 5 is a top plan view of the plastic drywell 20 showing that the flow of water due to the knock out of the small diameter drain ports has been distributed generally 90° as illustrated by the arrows away from the inlet pipe 16 which discharges surface water into the plastic drywell 20.

The improved plastic drywell, the drywell system and the method of installation and use provide for an easy, effective and simple method of controlling the flow and direction of surface water and permits flexibility of the user to select desired large or small diameter ports for distribution of water. Of course, as recognized, the improved plastic drywell may include not only large and small diameter ports, but a whole series of ports of different diameters and distribution in the walls of the plastic drywell as desired in order to permit the control and flow and distribution of surface water.

What is claimed is:

1. A drywell drainage system for the subterranean distribution of surface water to a drain field which system comprises:

(a) a water source of surface water to be subterraneally flow distributed away from the water source;

(b) a drywell positioned beneath the ground and having a cylindrical wall;

(i) at least one large diameter inlet port in the cylindrical wall of the drywell to receive the surface water;

(ii) a plurality of drain ports having a smaller diameter than the inlet port and distributed about the periphery and length of the cylindrical wall surface of the drywell;

(iii) a removable bottom cover;

(iv) a removable top cover; and (v) the drain ports having a mechanically weaker peripheral inner section, the inner section adapted to be easily removed prior to use whereby the direction and amount of the flow of surface water discharged from the drain ports of the drywell may be controlled by the selection of the inner section of the drain ports removed; and (c) means to direct the flow of surface water from the water source into the drywell.

2. The system of claim 1 wherein the inlet port has a diameter of about four inches or greater and the drain ports have a diameter of about two to three inches.

3. The system of claim 1 wherein the bottom cover has been removed to permit surface water to drain from the bottom of the drywell.

4. The system of claim 1 wherein the top cover is characterized by an opening therein to receive a grate.

5. The system of claim 4 wherein the top cover includes a grate, and the top cover and grate are generally flush with or slightly below the ground surface.

6. The system of claim 1 wherein the inlet port is positioned on one side wall of the drywell and the drain ports with removed sections are on the opposite side of the inlet port to permit water flow in a 60° to 120° section of the opposite wall of the drywell.

7. The system of claim 1 wherein the drywell includes a plurality of large diameter ports in the upper section of the cylindrical wall.

8. The system of claim 1 wherein the inlet port is positioned in the upper section of the cylindrical wall of the drywell and one or more large diameter discharge ports are positioned in the upper section of the cylindrical wall.

9. The system of claim 1 wherein drywell comprises a hard, integral molded plastic with the removable port sections secured by peripheral tabs to the surrounding wall section of the drywell.

10. The system of claim 1 wherein the means to direct includes pipe means to connect the water source to the inlet port of the drywell.

11. The system of claim 1 wherein the inlet port includes a mechanically weakened peripheral section adapted to be easily removed in use for the insertion of a pipe therein for the introduction or withdrawal of water from the drywell.

12. The system of claim 1 which includes a plurality of drywells arranged generally vertically one on top of the other with the top or bottom cover removed to permit the vertical flow of water between adjacently arranged drywells.

13. The system of claim 1 which includes a plurality of drywells arranged in series to include pipe means to permit the flow of the surface water from the upstream drywell to the last downstream drywell.

14. A plastic cylindrical drywell for use in a drywell system for the controlled flow of surface water which drywell comprises:

(a) at least one large diameter port in the cylindrical wall of the drywell to receive or discharge surface water from a surface water source;

(b) a plurality of drain ports having a smaller diameter than the large diameter port distributed about the periphery and length of the cylindrical wall surface of the drywell;

(c) removable bottom cover;

(d) removable top cover;

(e) the larger and smaller diameter ports having a mechanically weakened peripheral inner section with the said section adapted to be easily removed prior to use whereby on selection of the drain ports to be removed the direct and amount of the surface water discharged from the drywell may be controlled.

15. The system of claim 1 wherein the drywell includes at least one large diameter discharge port generally directly opposite the inlet port.

16. A method for the controlled flow of surface water from a surface water source, which method comprises:

(a) providing a cylindrical drywell to receive surface water, the drywell comprising:

(i) at least one diameter port in the cylindrical wall of the drywell to receive surface water from a surface water source;

(ii) a plurality of drain ports having a smaller diameter than the large diameter port distributed about the periphery and length of the cylindrical wall surface of the drywell;

(iii) a removable bottom cover;

(iv) a removable top cover; and (v) the smaller diameter ports having a mechanically weakened peripheral inner section with the said section adapted to be easily removed prior to use whereby on selection of the drain port the direction and amount of the surface water discharged from the drywell may be controlled;

(b) selectively removing a plurality of the inner sections of the drain ports as required to provide the desired direction of flow of the surface water from the drain ports;

(c) installing the drywell so that the top cover is flush or below the ground surface; and (d) directing surface water into the interior of the drywell.

17. The system of claim 1 wherein the source of water comprises water from the roof of a building.

18. The system of claim 1 wherein the drywell contains aggregate material therein.

19. A plastic cylindrical drywell for use in a drywell system for the controlled flow of surface water which drywell comprises:

(a) at least one large diameter port in the cylindrical wall of the drywell to receive or discharge surface water from a surface water source;

(b) a plurality of drain ports having a smaller diameter than the large diameter port distributed about the periphery and length of the cylindrical wall surface of the drywell;

(c) removable bottom cover;

(d) removable top cover;

(e) the larger and smaller diameter ports having a mechanically weakened peripheral inner section with the said section adapted to be easily removed prior to use whereby on selection of the drain ports to be removed the direct and amount of the surface water discharged from the drywell may be controlled.

20. The drywell of claim 19 wherein the top cover is characterized by an opening to receive a grate and the drywell includes a grate in the grate opening.

21. A method for the controlled flow of surface water from a surface water source, which method comprises:

(a) providing a cylindrical drywell to receive surface water, the drywell comprising:

(i) at least one large diameter port in the cylindrical wall of the drywell to receive surface water from a surface water source;

(ii) a plurality of drain ports having a smaller diameter than the large diameter port distributed about the periphery and length of the cylindrical wall surface of the drywell;

(iii) a removable bottom cover;

(iv) a removable top cover; and (v) the smaller diameter ports having a mechanically weakened peripheral inner section with the said section adapted to be easily removed prior to use whereby on selection of the drain port the direction and amount of the surface water discharged from the drywell may be controlled;

(b) selectively removing a plurality of the inner sections of the drain ports as required to provide the desired direction of flow of the surface water from the drain ports;

(c) installing the drywell so that the top cover is flush or below the ground surface; and (d) directing surface water into the interior of the drywell.

22. The method of claim 21 which includes directing surface water from the surface water source into a grate in the top cover which grate is generally flush or slightly below the ground surface.

23. The method of claim 21 which includes directing surface water from the surface water source into a pipe and installing the pipe so the surface water discharges into the large diameter port of the drywell.

24. The method of claim 21 which includes selectively removing the inner sections to provide for the flow of water in a general fan shape flow direction from the wall of the drywell.

* * * * *

UNITED STATES PATENT AND TRADEMARK OFFICE
CERTIFICATE OF CORRECTION

PATENT NO. : 4,983,069

DATED : Jan. 8, 1991

INVENTOR(S) : Thomas Florence

It is certified that error appears in the above-identified patent and that said Letters Patent is hereby corrected as shown below:

Column 6, lines 26-44 (claim 14), should be deleted and substitute therefor:

--14. The system of claim 1 wherein the drain ports are cylindrical ports and the inner sections are small cylindrical sections and the inner sections secured to the wall of the drywell by mechanically weak tabs of less thickness than the wall of the drywell.--.

Column 6, lines 48-68 and column 7, lines 1-6 (claim 16), should be deleted and substitute therefor:

--16. The system of claim 1 wherein the discharge ports include mechanically weaker inner sections which may be easily removed prior to use. --.

Signed and Sealed this

Twenty-third Day of November, 1993

*Attest:*

Bruce Lehman

BRUCE LEHMAN

*Attesting Officer*

*Commissioner of Patents and Trademarks*